US006520531B1

(12) United States Patent
Gien

(10) Patent No.: US 6,520,531 B1
(45) Date of Patent: Feb. 18, 2003

(54) BOOT SUPPORT ADJUSTING DEVICE FOR SKI BOARD OR THE LIKE

(76) Inventor: Yu Tze Gien, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/915,321

(22) Filed: Jul. 27, 2001

(51) Int. Cl.[7] ..... A63C 9/081

(52) U.S. Cl. ..... 280/618; 280/14.24; 403/13; 403/96

(58) Field of Search ..... 280/607, 617, 280/618, 14.21, 14.22, 14.24, 620, 624, 633, 634, 613; 403/96, 92, 97, 12, 13

(56) References Cited

U.S. PATENT DOCUMENTS

| | | | | | |
|---|---|---|---|---|---|
| 3,583,734 | A | * | 6/1971 | Magi | 403/96 |
| 5,782,476 | A | * | 7/1998 | Fardie | 280/14.2 |
| 5,868,416 | A | * | 2/1999 | Fardie | 280/607 |
| 5,890,729 | A | * | 4/1999 | Bayer et al. | 280/618 |
| 5,947,488 | A | * | 9/1999 | Gorza et al. | 280/14.2 |
| 6,206,402 | B1 | * | 3/2001 | Tanaka | 280/607 |
| 6,234,494 | B1 | | 5/2001 | Gien | 280/14.24 |

FOREIGN PATENT DOCUMENTS

| | | |
|---|---|---|
| EP | 285558 | * 10/1988 |
| FR | 2627097 | * 8/1989 |

OTHER PUBLICATIONS

Printout from Internet Web Site www.proquest.umi.com dated Jan. 1998.*

* cited by examiner

*Primary Examiner*—Brian L. Johnson
*Assistant Examiner*—Bryan Fischmann

(57) ABSTRACT

A boot support includes a disc solidly secured on a ski board and engaged with a bracket for rotatably securing the bracket to the ski board. One or more pawls are disposed between the disc and the ski board and are forced to to engage with the bracket and to secure the bracket to the disc and the ski board. The pawls may be solidly retained between the disc and the ski board and may be solidly forced to engage with the bracket for securing the bracket to the ski board after the bracket has been rotated relative to the ski board to the required suitable angular position.

13 Claims, 6 Drawing Sheets

BOOT SUPPORT ADJUSTING DEVICE FOR SKI BOARD OR THE LIKE

BACKGROUND OF THE INVENTION

1. Field of the Invention

The present invention relates to a boot support, and more particularly to a boot support having an angular adjusting device for adjustably securing onto a ski board or the like.

2. Description of the Prior Art

Typical boot supports comprise a bracket secured onto a ski board with fasteners for supporting a ski boot thereon. For adjusting the bracket and the ski boot relative to the ski board to the suitable angular position, the fasteners should all be disengaged from the bracket and should all be secured onto the bracket and the ski board again after the bracket has been adjusted relative to the ski board.

In order to solve such problems, the applicant has developed a boot support adjusting device for easily and quickly adjusting the angular position of the boot support relative to the ski board. The boot support adjusting device has been issued as U.S. Pat. No. 6,234,494 to Gien, and issued on May 22, 2001. However, the boot support adjusting device includes a pawl loosely secured to a disc and thus may not be used for solidly securing the boot support to the ski board. The pawl may not be solidly secured or retained or guided to move relative to the disc.

The present invention has arisen to mitigate and/or obviate the afore-described disadvantages of the conventional boot supports.

SUMMARY OF THE INVENTION

The primary objective of the present invention is to provide a boot support including an adjusting device for easily and quickly adjusting the boot support relative to the ski board to various angular positions without disengaging the adjusting device from the ski board.

In accordance with one aspect of the invention, there is provided a boot support comprising a ski board, a bracket disposed on the ski board for supporting a ski boot and having an opening formed therein, a disc secured to the ski board and engaged with the bracket for rotatably securing the bracket to the ski board, a pair of pawls disposed between the disc and the ski board, and slidably received in the opening of the bracket, and means for forcing the pawls to move away from each other and to engage with the bracket and to secure the bracket to the disc and the ski board. The pawls may be solidly retained between the disc and the ski board and may be solidly forced to engage with the bracket for securing the bracket to the ski board after the bracket has been rotated relative to the ski board to the required suitable angular position.

The bracket includes a plurality of teeth formed therein and formed around the opening thereof, the pawls each includes at least one tooth for engaging with the teeth of the bracket and for adjustably and selectively securing the bracket to the ski board.

A device is further provided for slidably securing the pawls to the disc, and includes at least two bulges extended downward from a bottom of the disc, and a plate secured to the bottom of the disc and having the bulges engaged between the disc and the plate for forming a space between the disc and the plate and for slidably receiving the pawls between the disc and the plate.

The pawls each includes at least one oblong hole formed therein for slidably receiving the bulges respectively and for guiding the pawls to move toward and away from the bracket, the boot support further includes means for biasing the pawls to move away from the bracket.

The disc includes two grooves formed therein, the pawls each includes an extension extended therefrom and engaged into the grooves of the disc respectively, the biasing means includes two springs engaged in the grooves of the disc respectively and engaged with the disc and the extensions of the pawls respectively for biasing the pawls away from the bracket.

The forcing means includes an actuator rotatably secured to the disc and received in the opening of the bracket for engaging with the pawls, and means for rotating the actuator to move the pawls to engage with and to be disengaged from the bracket.

A knob is further provided and secured to the actuator for rotating the actuator relative to the disc and for actuating the actuator to move the pawls to engage with and to be disengaged from the bracket.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
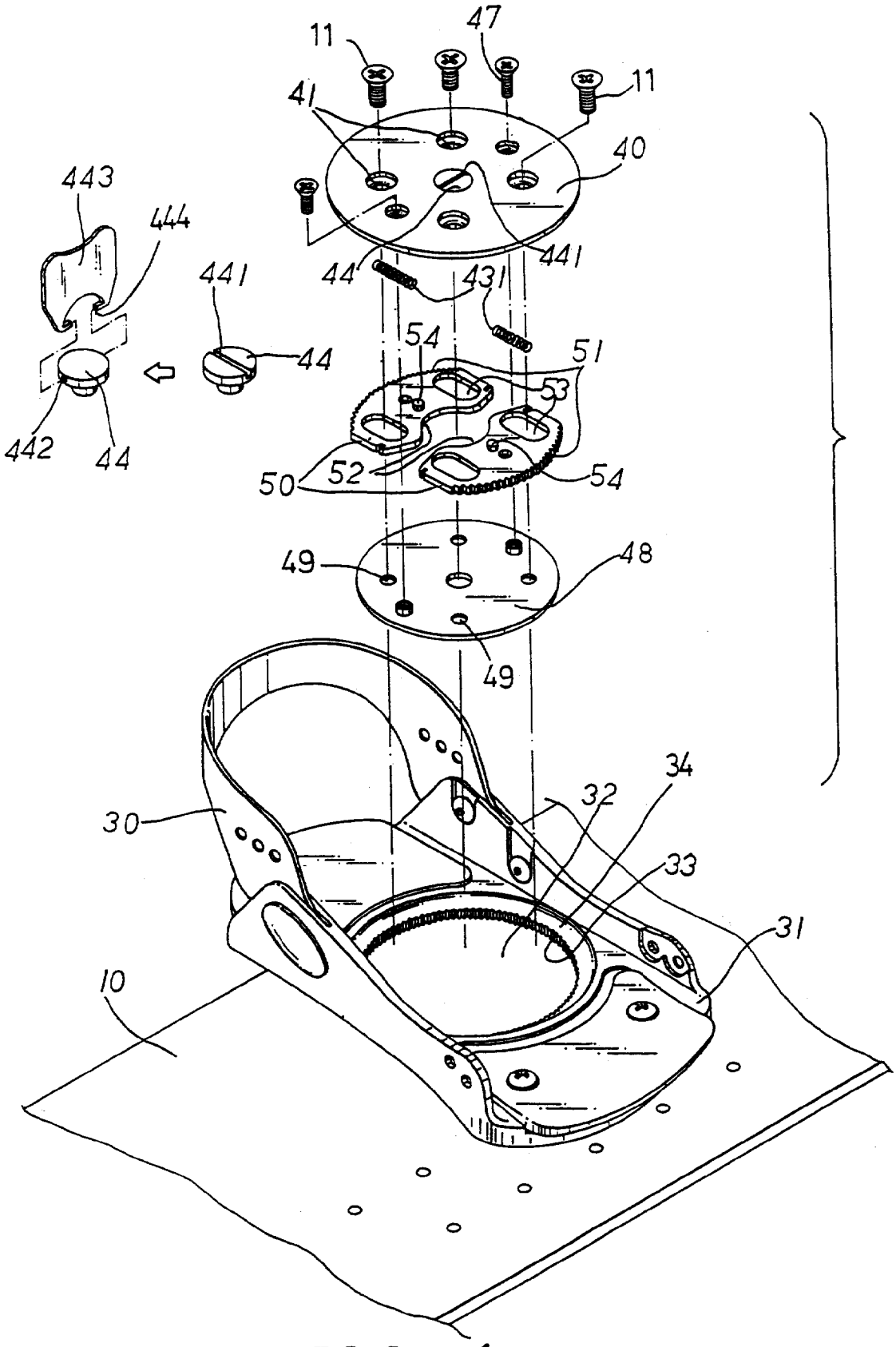
FIG. 1 is an exploded view of a boot support in accordance with the present invention.
Figure 3:
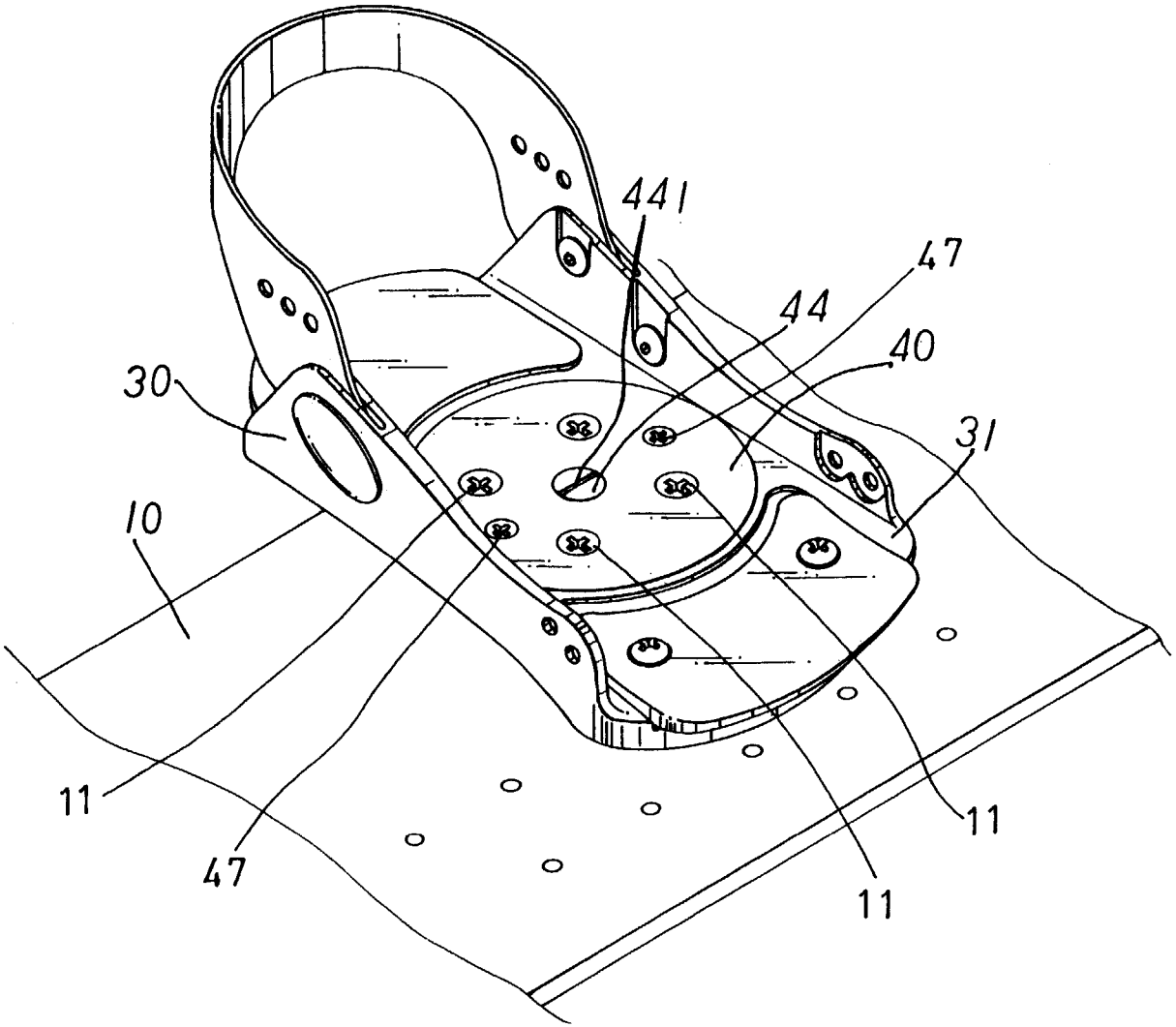
FIG. 3 is a partial perspective view of the boot support.

Referring to the drawings, and initially to FIGS. 1–6, a boot support 30 in accordance with the present invention is disposed on and to be secured on top or on the middle portion of a ski board 10 with fasteners or the like. The boot support 30 includes a bracket 31 having an opening 32 formed therein, and having a peripheral or annular shoulder 34 formed therein, and having a number of teeth 33 formed therein and formed around the opening 32 and/or the annular shoulder 34 of the bracket 31. A disc 40 is to be secured onto the ski board 10 with fasteners 11 or the like and includes a radially outer peripheral portion for engaging with the annular shoulder 34 of the bracket 31 for rotatably securing the bracket 31 to the ski board 10 with the disc 40.

Figure 2:
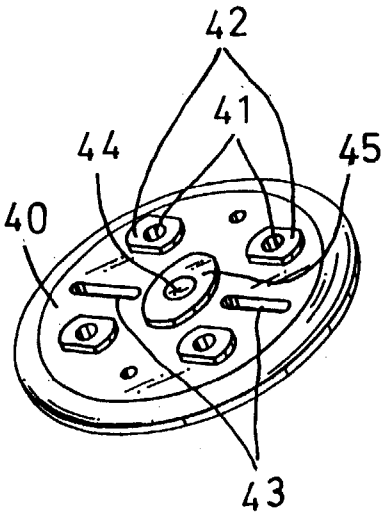
FIG. 2 is a bottom perspective view of a disc.

As best shown in FIG. 2, the disc 40 includes one or more orifices 41 formed therein for receiving the fasteners 11, and includes one or more spacers or bulges 42 extended downward therefrom. For example, the disc 40 includes four bulges 42 extended downward therefrom, and aligned with the orifices 41 thereof respectively. The disc 40 includes one or more, such as two grooves 43 formed in the bottom portion thereof and aligned with each other for receiving spring members 431 therein respectively. A plate 48 is engaged onto the bottom surface of the bulges 42 and secured to the disc 40 with fasteners 47 or the like, such that a gap or a space may be formed between the disc 40 and the. plate 48 by the bulges 42, best shown in FIGS. 6–8. The plate 48 includes one or more holes 49 formed therein for receiving the fasteners 11 and for allowing the fasteners 11 to be threaded to and secured to the ski board 10.

A pair of pawls 50 are slidably received in the space formed between the disc 40 and the plate 48, and each includes one or more teeth 51 formed thereon, such as formed on the outer peripheral portion thereof for engaging with the teeth 33 of the bracket 31, and includes one or more oblong holes 53 formed therein for slidably receiving the bulges 42 and for guiding the pawls 50 to move toward and away from the teeth 33 of the bracket 31, or for guiding the pawls 50 to move toward or away from each other. The pawls 50 each includes an extension 54 extended therefrom and engaged into the grooves 43 of the disc 40 respectively for engaging with the spring members 431 respectively, and for allowing the spring members 431 to bias the pawls 50 away from the teeth 33 of the bracket 31. The pawls 50 each includes a curved engaging surface 52 formed therein, such as formed in the inner portion thereof.

Figure 4:
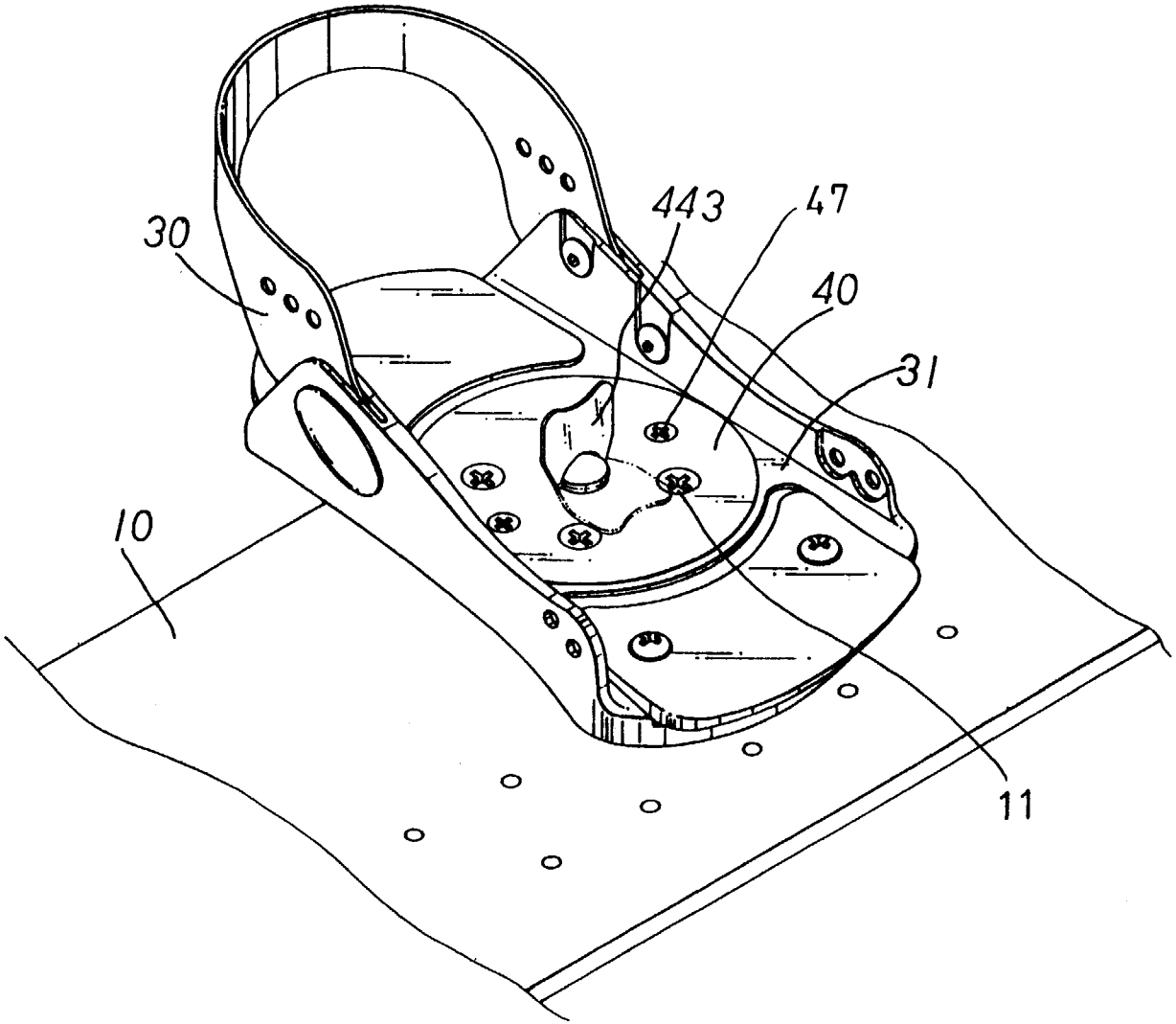
FIG. 4 is a partial perspective view similar to FIG. 3, illustrating the other arrangement of the boot support.
Figure 5:
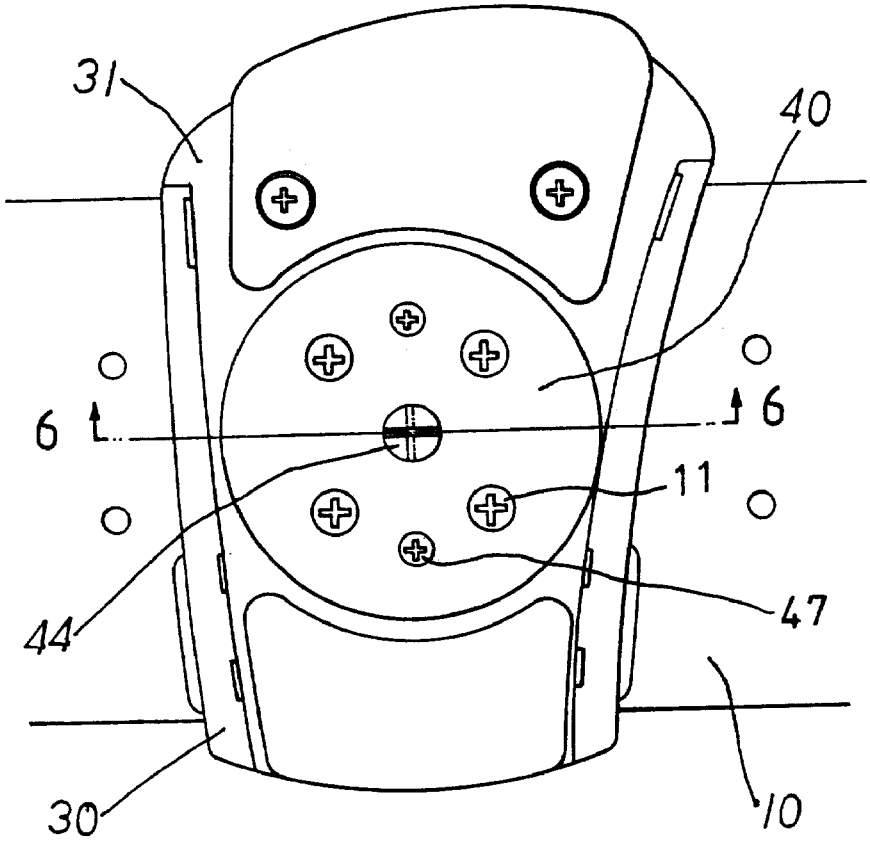
FIG. 5 is a partial top view of the boot support.
Figure 6:
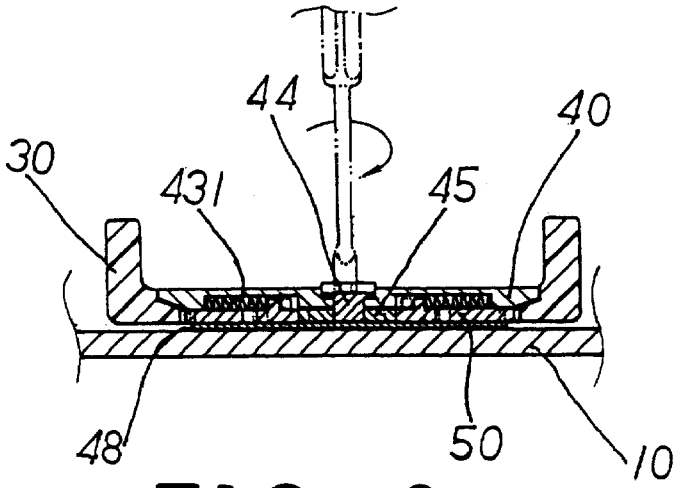
FIG. 6 is a cross sectional view taken along lines 6–6 of FIG. 5.

An actuator 45 is rotatably received between the pawls 50 and includes two cams or two ends or the like for engaging with the curved engaging surfaces 52 of the pawls 50 respectively and for moving and forcing the teeth 51 of the pawls 50 to engage with the teeth 33 of the bracket 31 against the spring members 431. The actuator 45 is rotatably secured to the bottom portion of the disc 40 with a fastener 44 which includes a slot 441 (FIGS. 1, 3, 5, 6) formed in the upper portion thereof for receiving a driving tool, as shown in dotted lines in FIG. 6, which may rotate the fastener 44 and thus the actuator 45 to force the teeth 51 of the pawls 50 to engage with the teeth 33 of the bracket 31 against the spring members 431. Alternatively, a hand grip or a knob 443 is pivotally secured to the actuator 45 with one or more hooks 444 which are engaged into the holes 442 of the fastener 44 and which form a pivot axle of the knob 443 to the fastener 44 of to the actuator 45, for allowing the knob 443 to be rotated relative to the actuator 45 to engage with or to be disengaged from the disc 40 (FIG. 4).

Figure 7:
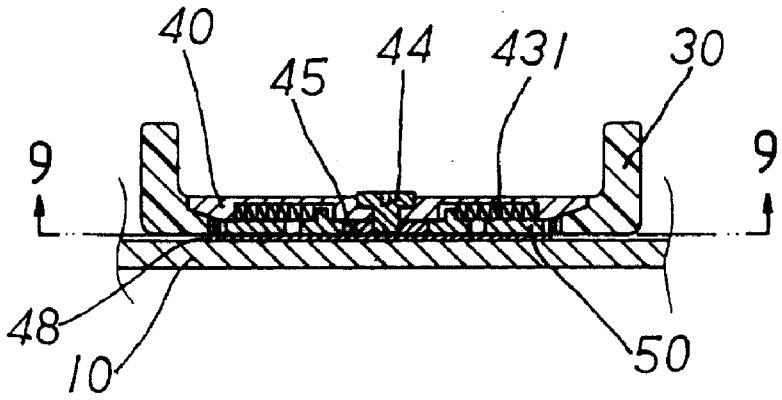
FIGS. 7, 8, are cross sectional views similar to FIG. 6, illustrating the operation of the boot support.
Figure 8:
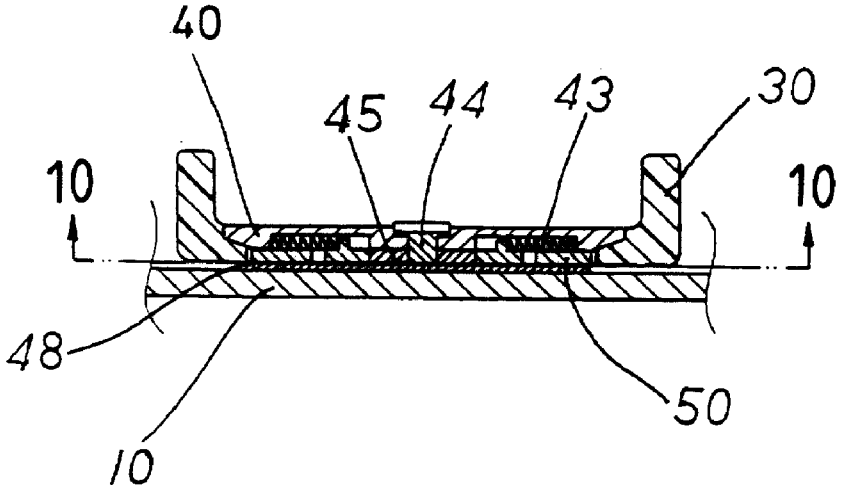
Figure 10:
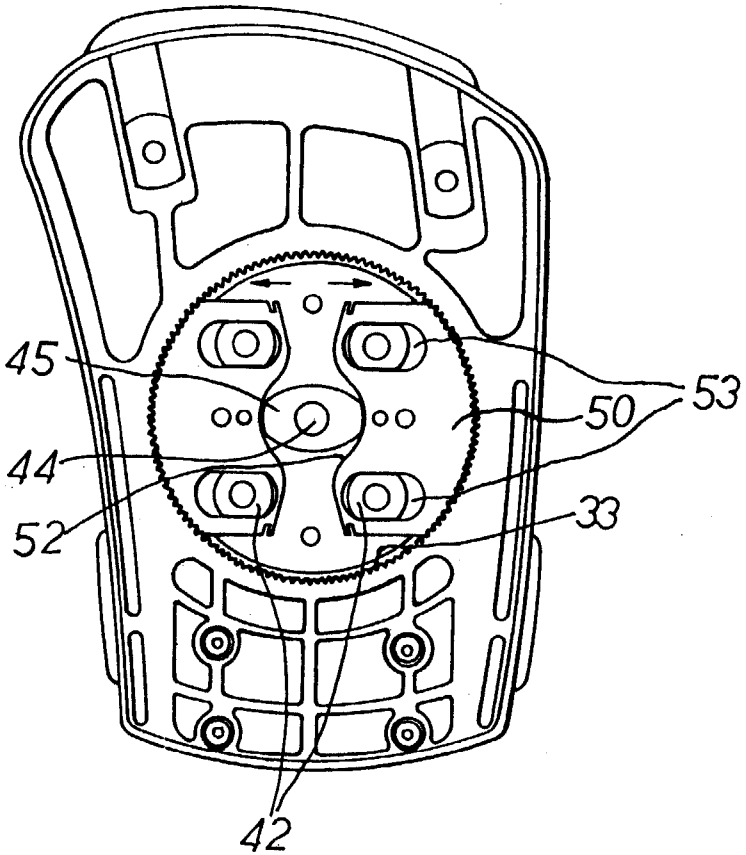
FIGS. 9, 10 are partial cross sectional views taken along lines 9—9, and 10—10 of FIGS. 7 and 8 respectively, illustrating the operation of the boot support.
Figure 9:
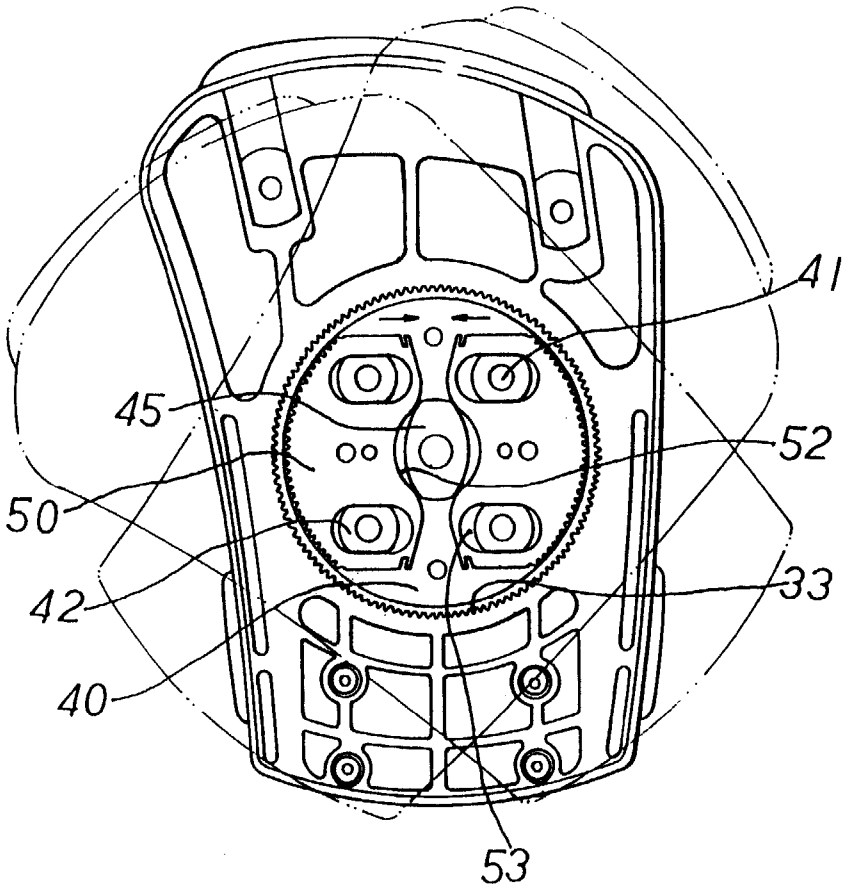

In operation, as shown in FIGS. 8 and 10, the pawls 50, particularly the teeth 51 of the pawls 50 may be caused or forced to engage with the teeth 33 of the bracket 31, against the spring members 431, by rotating the actuator 45 with the knob 443 or with the other driving tools. As shown in FIGS. 7 and 9, when the actuator 45 is rotated relative to the disc 40 and thus the pawls 50 and is disengaged from the engaging surfaces 52 of the pawls 50, the spring members 431 bias the pawls 50 away from the teeth 33 of the bracket 31, best shown in FIG. 9, such that the bracket 31 may be easily and quickly rotated and adjusted relative to the ski board 10, as shown in dotted lines in FIG. 9. The bracket 31 may be secured and locked to the ski board 10 and the disc 40 again by rotating the actuator 45 to engage with and to force the pawls 50 toward or to engage with the teeth 33 of the bracket 31, after the bracket 31 has been adjusted to the required angular position relative to the ski board 10 and the disc 40. The disc 40 and/or the fasteners 11, 47 are not required to be disengaged from the ski board 10.

It is to be noted that the pawls 50 may be stably and slidably retained between the disc 40 and the plate 48, such that the engagement of a single pawl 50 with the bracket 31 is good enough to secure the bracket 31 to the ski board 10 at the required angular position. However, it is preferably that two pawls 50 are provided and are forced away from each other to further solidly engage with the bracket 31.

Accordingly, the boot support in accordance with the present invention includes an adjusting device for easily and quickly adjusting the boot support relative to the ski board to various angular positions without disengaging the adjusting device from the ski board.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A boot support comprising:

a board, a bracket disposed on said board for supporting a boot, said bracket including an opening formed therein, a disc secured to said board and engaged with said bracket for rotatably securing said bracket to said board, said disc including a bottom having at least one bulge extended downward therefrom, a plate secured to said bottom of said disc and having said at least one bulge engaged between said disc and said plate for forming a space between said disc and said plate, at least one pawl disposed in said space formed between said disc and said plate, and slidably received in said opening of said bracket, and means for forcing said at least one pawl to engage with said bracket and to secure said bracket to said disc.

2. The boot support according to claim 1, wherein said bracket includes an annular shoulder formed therein, said disc includes a peripheral portion engaged with said annular shoulder of said bracket for rotatably securing said bracket to said disc.

3. The boot support according to claim 1, wherein said bracket includes a plurality of teeth formed therein and formed around said opening thereof, said at least one pawl includes at least one tooth for engaging with said teeth of said bracket.

4. The boot support according to claim 1 further comprising means for guiding said at least one pawl to move toward and away from said bracket.

5. The boot support according to claim 4, wherein guiding means includes at least one bulge extended from said disc and extended inward of said opening of said bracket, and includes at least one oblong hole formed in said at least one pawl for slidably receiving said at least one bulge and for guiding said at least one pawl to move toward and away from said bracket.

6. The boot support according to claim 1, wherein said at least one pawl includes at least one oblong hole formed therein for slidably receiving said at least one bulge and for guiding said at least one pawl to move toward and away from said bracket.

7. The boot support according to claim 1, wherein said forcing means includes an actuator rotatably secured to said disc and received in said opening of said bracket for engaging with said at least one pawl, and a knob secured to said actuator for rotating said actuator relative to said disc and for actuating said actuator to move said at least one pawl to engage with and to be disengaged from said bracket.

8. The boot support according to claim 1 further comprising means for biasing said at least one pawl away from said bracket.

9. A boot support comprising:

a board, a bracket disposed on said board for supporting a boot, said bracket including an opening formed therein, a disc secured to said board and engaged with said bracket for rotatably securing said bracket to said board, said disc including a bottom having at least two bulges extended downward therefrom, a plate secured to said bottom of said disc and having said at least two bulges engaged between said disc and said plate for forming a space between said disc and said plate, a pair of pawls disposed in said space formed between said disc and said plate, and slidably received in said opening of said bracket, and means for forcing said pawls to move away from each other and to engage with said bracket and to secure said bracket to said disc.

10. The boot support according to claim 9, wherein said bracket includes a plurality of teeth formed therein and formed around said opening thereof, said pawls each includes at least one tooth for engaging with said teeth of said bracket.

11. The boot support according to claim 12, wherein said pawls each includes at least one oblong hole formed therein for slidably receiving said at least two bulges respectively and for guiding said pawls to move toward and away from said bracket, said boot support further includes means for biasing said pawls to move away from said bracket.

12. The boot support according to claim 11, wherein said disc includes two grooves formed therein, said pawls each includes an extension extended therefrom and engaged into said grooves of said disc respectively, said biasing means includes two springs engaged in said grooves of said disc respectively and engaged with said disc and said extensions of said pawls respectively for biasing said pawls away from said bracket.

13. The boot support according to claim 9, wherein said forcing means includes an actuator rotatably secured to said disc and received in said opening of said bracket for engaging with said pawls, and a knob secured to said actuator for rotating said actuator relative to said disc and for actuating said actuator to move said pawls to engage with and to be disengaged from said bracket.

* * * * *